US011375809B2

(12) United States Patent
Sharpley

(10) Patent No.: US 11,375,809 B2
(45) Date of Patent: Jul. 5, 2022

(54) WISHING WELL TABLE

(71) Applicant: Gari Sharpley, Maple Heights, OH (US)

(72) Inventor: Gari Sharpley, Maple Heights, OH (US)

( * ) Notice: Subject to any disclaimer, the term of this patent is extended or adjusted under 35 U.S.C. 154(b) by 65 days.

(21) Appl. No.: 16/804,225

(22) Filed: Feb. 28, 2020

(65) Prior Publication Data

US 2020/0275776 A1 Sep. 3, 2020

Related U.S. Application Data

(60) Provisional application No. 62/812,323, filed on Mar. 1, 2019.

(51) Int. Cl.

| | |
|---|---|
| ***A47B 83/04*** | (2006.01) |
| ***A47B 13/08*** | (2006.01) |
| ***A47B 37/00*** | (2006.01) |
| ***A47B 3/06*** | (2006.01) |
| ***A47B 3/00*** | (2006.01) |

(52) U.S. Cl.

CPC ..... *A47B 83/04* (2013.01); *A47B 3/002* (2013.01); *A47B 3/06* (2013.01); *A47B 13/08* (2013.01); *A47B 37/00* (2013.01); *A47B 2200/0001* (2013.01); *A47B 2200/0084* (2013.01)

(58) Field of Classification Search

CPC ..... B65D 81/368; A47B 83/04; A47B 3/002; A47B 3/06; A47B 13/08; A47B 37/00; A47B 2200/0001; A47B 2200/0084

See application file for complete search history.

(56) References Cited

U.S. PATENT DOCUMENTS

| | | | | |
|---|---|---|---|---|
| 5,100,002 | A * | 3/1992 | Garran | B65D 81/368 206/223 |
| 5,778,800 | A * | 7/1998 | Liang | A47B 88/493 108/26 |
| 6,581,822 | B1 * | 6/2003 | Garran | B65D 5/425 206/457 |
| 2005/0204963 | A1 * | 9/2005 | Robinson | A47B 13/16 108/25 |
| 2006/0059858 | A1 * | 3/2006 | Layman | E04D 15/02 52/749.12 |
| 2007/0056482 | A1 * | 3/2007 | Robinson | A47B 37/04 108/25 |
| 2014/0238799 | A1 * | 8/2014 | Sharma | B62B 1/125 190/11 |
| 2020/0305617 | A1 * | 10/2020 | Sharpley | A47B 13/16 |

* cited by examiner

*Primary Examiner* — Matthew W Ing
(74) *Attorney, Agent, or Firm* — Daniel M. Cohn; Howard M. Cohn

(57) ABSTRACT

A wishing well table is to temporarily hold gifts. The wishing well table includes a table formed of a table top supported by a plurality of legs. The wishing well table further includes an aperture disposed through the tabletop. A removable pouch is attached to the aperture to receive the gifts. Finally, a wishing well is disposed over the aperture having an opening to receive the gifts to fall through the aperture into the removable pouch.

11 Claims, 3 Drawing Sheets

WISHING WELL TABLE

CROSS REFERENCE TO RELATED APPLICATIONS

This application claims the benefit of U.S. Provisional Patent Application No. 62/812,323 filed on Mar. 1, 2019, which is incorporated in its entirety by reference herein.

TECHNICAL FIELD OF THE INVENTION

The present invention relates to a wishing well table, and more particularly to a table top supported by a plurality of legs, having an aperture disposed through the tabletop, a removable pouch attached to the aperture, and a wishing well disposed over the aperture having an opening therethrough.

BACKGROUND OF THE INVENTION

There are many special or festive occasions in which family members and other guests give gifts to the person or persons being recognized, such as wedding receptions, bridal showers, baby showers, anniversaries, birthday parties, graduation parties, retirement parties, "house-warming" parties, and the like. Furthermore, there are many religious occasions in which guests traditionally give gifts such as baptisms, communions, confirmations, bar mitzvahs, bat mitzvahs, and the like.

While many gift givers choose to give tangible gifts on such festive or religious occasions, it is also customary to give a monetary gift in the form of cash, check or gift certificate. A monetary gift allows the recipient the freedom to decide how the gift may be used.

At a wedding reception, for example, it is common that the gift givers place their gift to the newlyweds on a large table as they enter into the reception area. For those guests who prefer to give a monetary gift, a large bowl or wishing well structure is often provided to collect and store the gifts during the monetary reception. The large bowl or wishing well structure is utilized in order to avoid the possibility of accidentally losing a gift or having a gift stolen from the reception area.

SUMMARY OF THE INVENTION

According to an embodiment of the present invention, there is disclosed a wishing well table to temporarily hold gifts. The wishing well table includes a table formed of a table top supported by a plurality of legs. The wishing well table further includes an aperture disposed through the tabletop. A removable pouch is attached to the aperture to receive the gifts. Finally, a wishing well is disposed over the aperture having an opening to receive the gifts to fall through the aperture into the removable pouch.

According to another embodiment of the present invention, there is disclosed a wishing well table to temporarily hold gifts. The wishing well table includes a table formed of a table top including an upper surface and bottom surface, and a plurality of legs that support the table. The wishing well table further includes an aperture disposed through the tabletop. A removable pouch is provided with reinforcement rings in the upper open part thereof. The removable pouch is secured to the aperture within the table top with a plurality of suspension members to receive the gifts. Finally, a wishing well is temporarily secured to the table top and disposed over the aperture having an opening to receive the gifts to fall through the aperture into the removable pouch.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
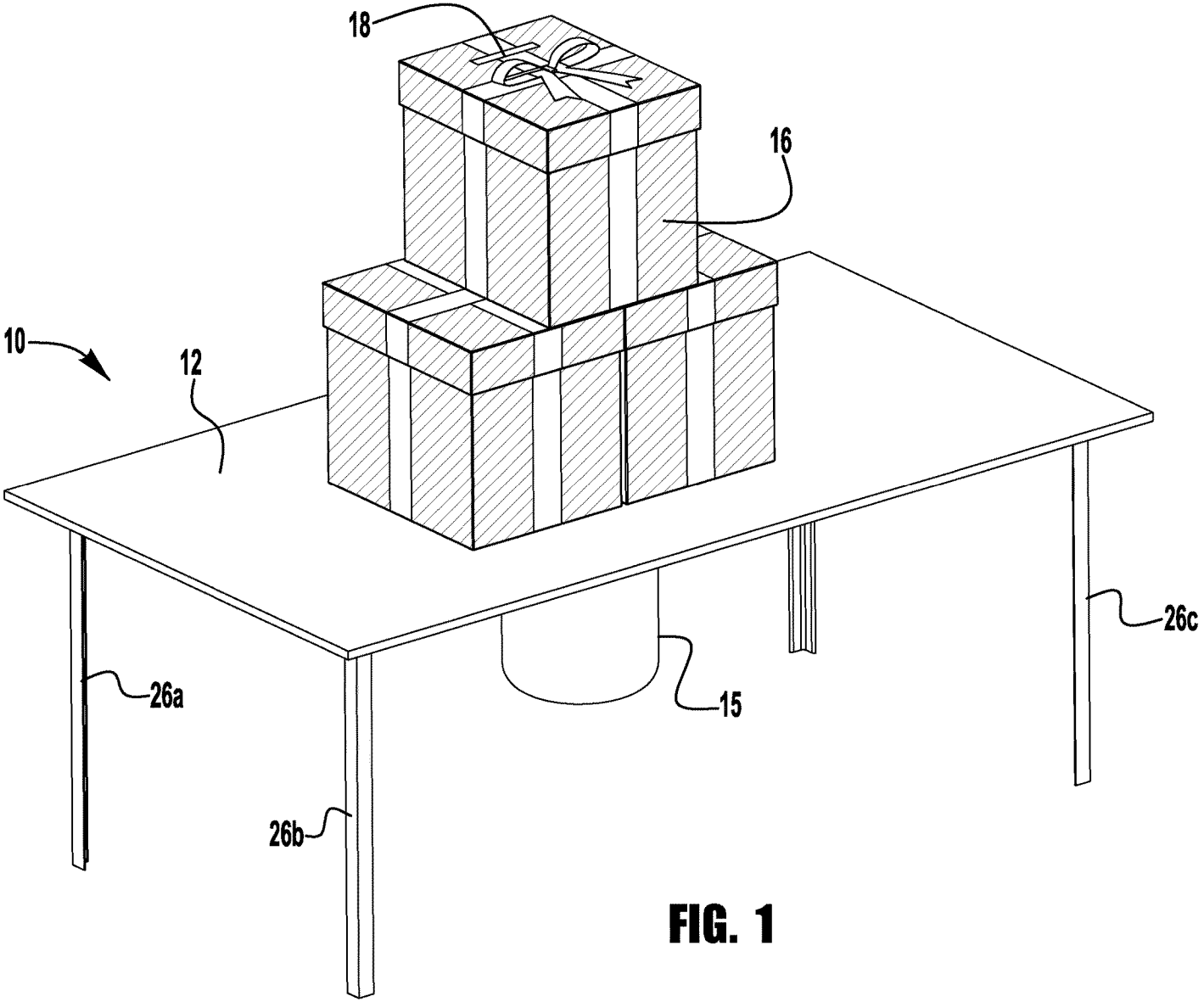
FIG. 1 is a front three-dimensional view of the wishing well table, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

Wedding guests and guests at certain other festive occasions such as bridal showers, baby showers, anniversary parties, graduations and retirement parties will usually give a gift to the person or persons being honored. While tangible gifts are frequently given on such occasions, in many cases both the giver of gift and the person(s) receiving the gift would prefer a cash gift. Frequently a giver does not know what present the would-be recipient would like to receive, and the recipient frequently prefers the freedom of selection, which is afforded by a cash gift.

As a result, cash gifts, whether in the form of actual cash, a check, or a gift certificate are frequently given on festive occasions such as those mentioned above. Sometimes a large bowl for receipt of such gifts is provided, but more often such gifts are merely placed on a table which invites a risk that some of the gifts will be accidentally lost.

Figure 2:
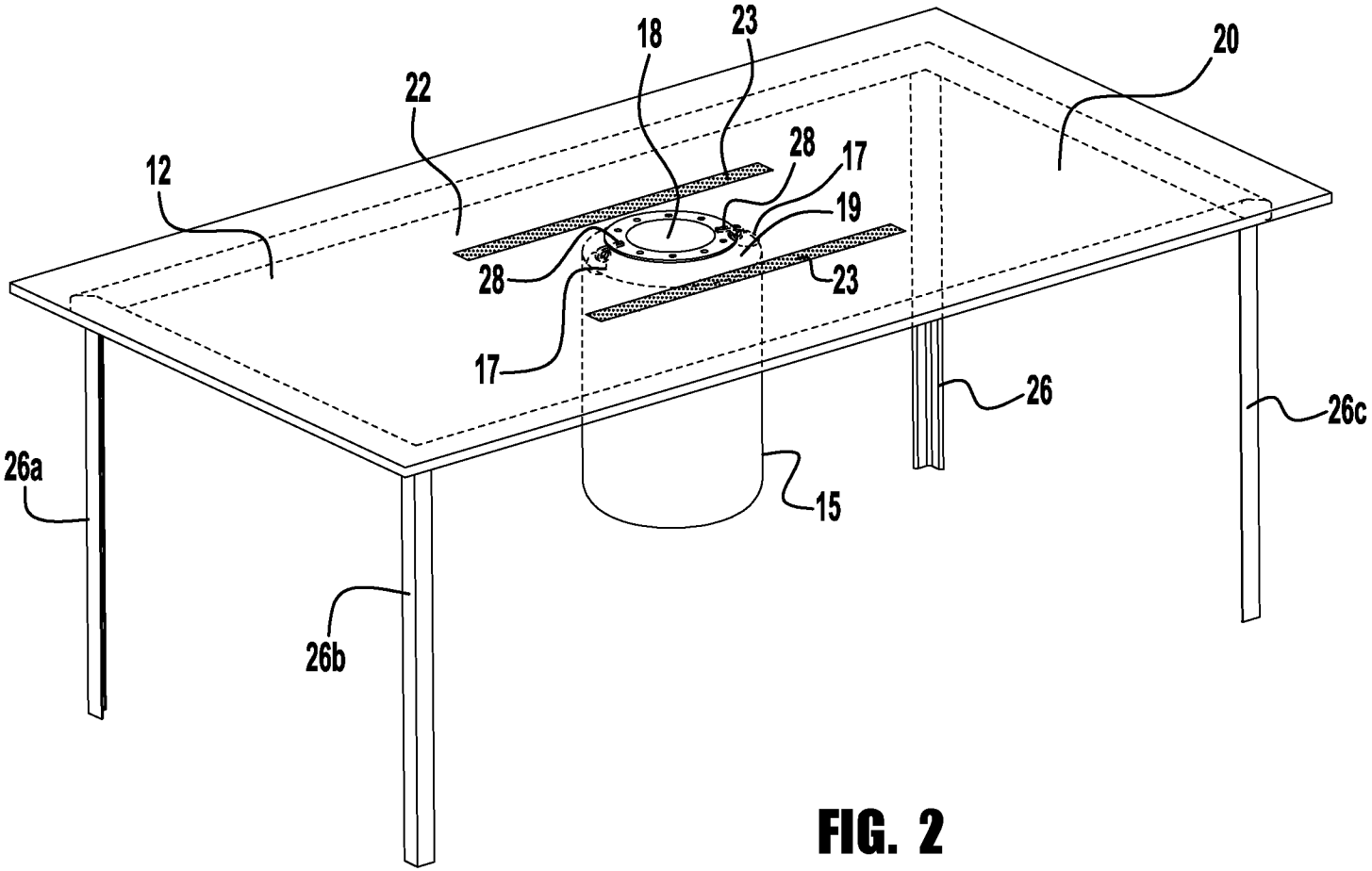
FIG. 2 is a front three-dimensional view of the table top and gift receptacle, in accordance with the present invention.

As illustrated in FIG. 1, the wishing well table 10 is designed as a table 12 to temporarily hold checks, envelopes, greeting cards, gift cards, and other presents in a removable pouch 15. A wishing well 16, as seen in FIG. 2, is disposed over an aperture 14 within the table 12. A check, greeting card, gift card, or envelope is inserted through an opening 18 within the wishing well 16, and then falls through the aperture 14 in the table 12, and lands within the removable pouch 15.

Referring to the FIG. 2, the table 12 comprises a table top 20 having an upper surface 22 and a bottom surface 24. The table 12 may be constructed of a variety of materials, such as metal, plastic or wood. The shape of the table 12 may be circular, square, rectangular, or any other desired shape. The standard height for the table 12 is 30 inches.

The table top 20 is supported by a plurality of legs 26, such as legs 26*a*, 26*b*, 26*c*, and 26*d*, although any number of legs may be utilized. These legs 26 may be fixed in place and are rigidly connected to the table top, Alternatively, the legs 26 may fold against the bottom surface 24 of the table top 20, such as is used on a card table. Near the center of the table is the aperture 14 to which the removable pouch 14 is attached. It should be noted that the table top 20 may be provided with more than one apertures 14, to accommodate a plurality of wishing wells 16. The aperture 14 may be located center, left or right side of the table 12 depending on the size and shape of the table. The table may also be folded in half with carrying handles or straps for easy transportation.

Although the aperture 14 is shown to have a circular or square configuration, it is envisioned that other configurations can be used, such as rectangular, triangular, etc., depending on the design choice. It is conceivable that table linen with a corresponding portion will be used to cover the aperture for special occasions.

The removable pouch 15 may be secured to the aperture 14 within the table top 20 in any desired fashion. For example, the inner surface of the aperture 14 may be provided with a plurality or variety of suspension members 28, which can be shaped as latches and/or hooks. Depending on the size of the opening, the number of hooks can be increased with the increased size of the aperture 14. The removable pouch 15 is suspended within the aperture 14 with the help of the suspension members.

The removable pouch 15 can be formed from any desired material, such as netting material or any fabric material. The removable pouch 15 may be provided with reinforcement rings 17 in the upper open part 19 thereof to facilitate suspending of the removable pouch from the suspension members 28. As can be seen in FIG. 2, the removable pouch 15 extends below the bottom surface 24 of the table top 20, to receive gifts and envelopes.

Figure 3:
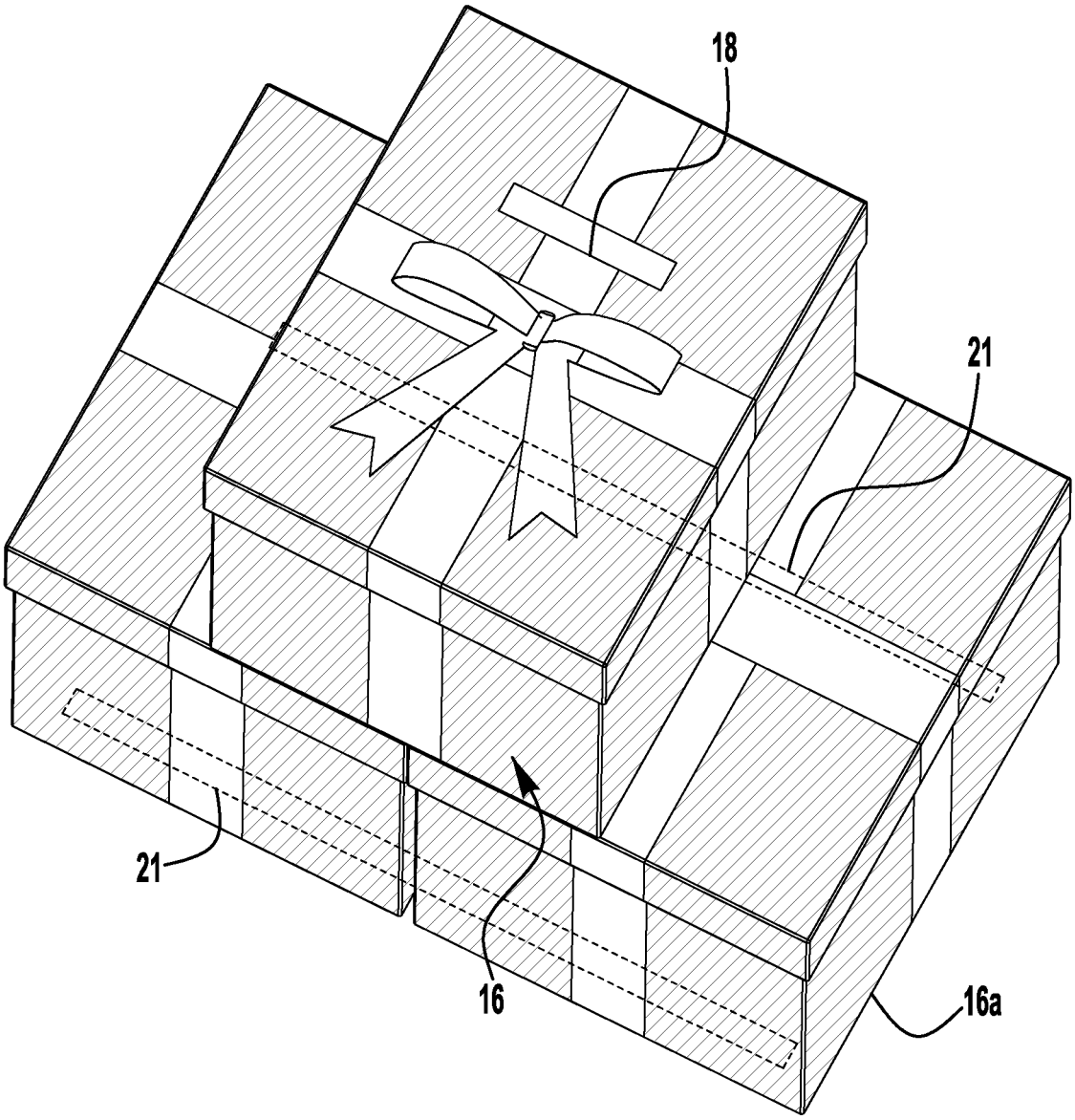
FIG. 3 is a three-dimensional view of the envelope receiving structure for use with the wishing well table, in accordance with the present invention.

As seen in FIG. 3, the wishing well 16 may include any shaped gift receptacle.

Although a three tiered gift receptacle is illustrated, any desired shape may be used. The wishing well 16 is adapted to receive monetary gifts through an opening or slot 18 located on the gift receptacle.

The wishing well 16 is baseless and is designed to sit directly over the aperture 14. According to the preferred embodiment, the slot 18 for receiving gifts into the monetary gift receptacle may be located in either the upright sides of the integral base or in the roof of the integral structure. The slot 18 for receiving gifts may be located anywhere on the gift receptacle 16, depending on its size. The site of the slot 18 will be selected based on the ease of accessibility to the removable pouch 15.

The wishing well 16 may be temporarily secured to the table top 20. For instance, there may be a Velcro strip 21 attached to the underside 16*a* of the wishing well 16 which can be secured to a corresponding Velcro strip 23 upon the upper surface 22 of the table top 20 surrounding the aperture 14, or any other like product.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A wishing well table to temporarily hold gifts, comprising;

a table formed of a table top supported by a plurality of legs;

an aperture disposed through the tabletop;

a removable pouch attached below the table top to the aperture to receive the gifts; a wishing well disposed over the aperture through the tabletop;

the wishing well sitting on the table top directly over the aperture being a three tiered, baseless receptacle having four upright sides and a roof having a slot therethrough to receive the gifts and to direct them through the upright sides of the receptacle into the aperture; and the wishing well disposed over the aperture having an opening to receive the gifts to fall through the aperture into the removable pouch.

2. The wishing well table of claim 1, wherein the table top includes an upper surface and a bottom surface.

3. The wishing well table of claim 2, wherein the table top is constructed in the shape from the group consisting of circular, square, rectangular, and triangular.

4. The wishing well table of claim 3, wherein the plurality of legs are fixed in place and are rigidly connected to the table top.

5. The wishing well table of claim 1, wherein the aperture is constructed in the shape from the group consisting of circular, square, rectangular, and triangular.

6. The wishing well table of claim 5, wherein the removable pouch is secured to the aperture within the table top with a plurality of suspension members disposed within openings surrounding the aperture.

7. The wishing well table of claim 6, wherein the plurality of suspension members are shaped as latches.

8. The wishing well table of claim 7, wherein the removable pouch is provided with reinforcement rings in the upper open part thereof to facilitate suspending of the removable pouch from the suspension members.

9. The wishing well table of claim 8, wherein the wishing well is adapted to receive monetary gifts through an opening is baseless and is designed to sit directly over the aperture.

10. The wishing well table of claim 9, wherein the wishing well is temporarily secured to the table top.

11. The wishing well table of claim 10, wherein the wishing well includes a Velcro strip attached to the underside of the wishing well table to be secured to a corresponding Velcro strip upon the upper surface of the table top surrounding the aperture.

* * * * *